US006369016B1

(12) United States Patent
Vlasblom

(10) Patent No.: US 6,369,016 B1
(45) **Date of Patent: *Apr. 9, 2002**

(54) HEAVY OIL REMOVER

(75) Inventor: Jack T. Vlasblom, Dunedin, FL (US)

(73) Assignee: Dotolo Research Ltd., Pinellas Park, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/436,078

(22) Filed: Nov. 8, 1999

(51) Int. Cl.[7] ..... C11D 1/83; C11D 3/44

(52) U.S. Cl. ..... 510/365; 510/417; 510/422; 510/424; 510/427; 510/432; 510/492; 510/495; 510/505; 510/506; 516/58

(58) Field of Search ..... 516/58; 510/365, 510/424, 427, 432, 492, 495, 505, 506, 417, 422

(56) References Cited

U.S. PATENT DOCUMENTS 4,135,878 A * 1/1979 Bishop et al. ..... 510/515
4,511,488 A * 4/1985 Matta ..... 510/365
4,620,937 A * 11/1986 Dellutri ..... 510/106
4,663,082 A * 5/1987 Bobsein et al. ..... 510/492
5,080,831 A * 1/1992 Van Eenam ..... 510/365
5,082,584 A * 1/1992 Loth et al. ..... 510/365
5,085,710 A * 2/1992 Goss ..... 134/40
5,213,624 A * 5/1993 Williams ..... 510/365
5,244,566 A * 9/1993 Bond ..... 510/365
5,277,836 A * 1/1994 Peters ..... 510/365
5,336,428 A * 8/1994 Kaplan et al. ..... 510/365
5,389,156 A * 2/1995 Mehta et al. ..... 134/10
5,449,474 A * 9/1995 Lucus et al. ..... 510/365
5,486,307 A * 1/1996 Misselyn et al. ..... 510/365
5,494,611 A * 2/1996 Howe ..... 510/365
5,516,459 A * 5/1996 Van Eenam ..... 510/365
5,527,486 A * 6/1996 De Guertechin ..... 510/365
5,538,662 A * 7/1996 Klier et al. ..... 510/417
5,597,792 A * 1/1997 Klier et al. ..... 510/417
5,712,236 A * 1/1998 Bolkan et al. ..... 510/492
5,747,439 A * 5/1998 Dunn et al. ..... 510/365
5,811,383 A * 9/1998 Klier et al. ..... 510/417
5,814,594 A * 9/1998 Vlasblom ..... 510/365
5,863,881 A * 1/1999 Vlasblom ..... 510/365
5,985,816 A * 11/1999 Vlasblom ..... 510/365
5,998,352 A * 12/1999 Vlasblom ..... 510/365
6,090,769 A * 7/2000 Vlasblom ..... 510/365
6,093,689 A * 7/2000 Vlasblom ..... 510/365
6,197,734 B1 * 3/2001 Vlasblom ..... 510/365
6,228,830 B1 * 5/2001 Vlasblom ..... 510/365
6,235,698 B1 * 5/2001 Vlasblom ..... 510/365
6,310,263 B1 * 10/2001 Vlasblom ..... 510/365

* cited by examiner

*Primary Examiner*—Daniel S. Metzmaier
(74) *Attorney, Agent, or Firm*—Donald R. Fraser

(57) ABSTRACT

A heavy oil remover comprises a hydrocarbon solvent, dipropylene glycol mono n-butyl ether, a volatility stabilizer, a salt of an alkyl aromatic sulfonic acid, a branched alcohol ethoxylate, an ethoxylated alkyl mercaptan, and water.

29 Claims, No Drawings

HEAVY OIL REMOVER

FIELD OF THE INVENTION

This invention relates generally to a heavy oil remover formulation. More particularly, the invention is directed to a composition useful for removing heavy oil and oily sludges from process equipment such as storage tanks, transfer piping, and pumping facilities.

BACKGROUND OF THE INVENTION

Compositions for heavy oil degreasing, capable of removing and displacing heavy oils from oil sludges left in process equipment, e.g., oil storage tanks, are known. The conventional heavy oil degreaser compositions contain so-called "alkaline builders." Moreover, many heavy oil remover compositions include halogens which are undesirable for steel process equipment degreasers, because the halogens may contribute to stress cracking of the metal. Many heavy oil degreasers only work at full strength, and are ineffective when diluted by residual liquids contained within the process equipment being cleaned. Some heavy oil degreasers are ineffective at ambient temperatures and must be heated along with the process equipment in order to remover the heavy oil sludge. Conventional heavy oil removers generally are incapable of absorbing and/or neutralizing the toxic gases and vapors which have accumulated within fouled process equipment.

U.S. Pat. No. 5,085,710 to Goss discloses a composition for removing oil sludges utilizing an alkylphenol adduct and a castor oil etholylate. U.S. Pat. No. 5,389,156 to Mehta et al discloses a heavy oil degreaser including a terpene and a second nonionic co-surfactant from the family of ethylene oxide/propylene oxide polyol adducts. These disclosed formulations suffer from a number of the undesirable characteristics listed above.

It would be desirable to prepare a heavy oil remover composition that is free from alkaline builders and halogens, effective even at significant levels of dilution and at ambient temperatures, capable of absorbing toxic gases and vapors such as hydrogen sulfide and benzene, and nontoxic.

SUMMARY OF THE INVENTION

Accordant with the present invention, there surprisingly has been discovered a heavy oil remover, comprising: from about 3 to about 96 weight percent hydrocarbon solvent; from about 1 to about 94 weight percent dipropylene glycol mono n-butyl ether; from about 1 to about 95 weight percent of a volatility stabilizer; from about 2 to about 95 weight percent salt of an alkyl aromatic sulfonic acid; from about 0.1 to about 75 weight percent branched alcohol ethoxylate; from about 0.1 to about 75 weight percent ethoxylated alkyl mercaptan; and up to about 95 weight percent water.

The heavy oil remover according to the present invention is particularly useful for removing residual oil sludges from fouled process equipment such as, for example, oil storage tanks.

DETAILED DESCRIPTION OF THE PREFERRED EMBODIMENTS

The heavy oil remover composition according to the present invention comprises a hydrocarbon solvent, dipropylene glycol mono n-butyl ether, a volatility stabilizer, a salt of an alkyl aromatic sulfonic acid, a branched alcohol ethoxylate, an ethoxylated alkyl mercaptan, and water.

The design of a high quality heavy oil remover requires attention to the chemical characteristics related to the performance enhancements required to achieve removal of heavy oils at ambient temperatures. Specifically, the most important chemical characteristics are solvency and detergency (or ability to emulsify). These factors affect the heavy oil remover s ability to clean and degrease metal surfaces, its impact on corrosion of the metal surfaces, and its ability to be safely handled.

The heavy oil remover according to the present invention exhibits the desired characteristics of solvency and detergency. Moreover, halogens are absent from the formulation, thus reducing the potential for stress cracking of the metal process equipment. The inventive formulation is effective at room temperatures, even when substantially diluted with water or residual process fluids. Finally, the composition can absorb toxic vapors such as hydrogen sulfide and benzene, yet is itself non-toxic.

In order to assure continued performance of the heavy oil remover under actual use conditions, the present formulation contains a volatility stabilizer. This enhances the formulation's aged heavy oil removing performance by slowing the evaporative losses of the other solvents, while synergistically working with the hydrocarbon solvent and dipropylene glycol mono n-butyl ether to provide improved heavy oil removing ability.

The hydrocarbon solvent according to the present invention may be a terpene or a petroleum solvent, or any mixture thereof. Suitable terpenes include diterpenes, triterpenes, and tetraterpenes which are generally head-to-tail condensation products of modified or unmodified isoprene molecules. The terpenes may be mono-, bi-, tri-, or tetracyclic compounds having varying degrees of unsaturation. Also contemplated as useful in the present invention are terpene derivatives, e.g., alcohols, aldehydes, etc., sometimes referred to as terpenoids, and mixtures of terpenes.

Petroleum solvents are well-known byproducts of the petroleum refining industry, and include by way of example but not limitation, light straight run gasoline, catalytic reformate, hydrocracked gasoline, catalytically cracked gasoline, polymer gasoline, alkylate, #1 fuel oil, #2 fuel oil, kerosene, jet fuel, diesel fuel, heating oil, furnace oil, naphtha, middle distillate, white oil, lubricating oil, gas oil, cyclopentane, methylcyclopentane, dimethylcyclopentane, cyclohexane, methylcyclohexane, 1,2-dimethylcyclohexane, decahydronaphthalene, and the like, as well as mixtures and derivatives thereof. A useful hydrocarbon solvent may be obtained from the Exxon Chemical Company under the trade designation "EXXOL D-60." Other useful hydrocarbon solvents include gasoline, diesel fuel, and gas oil. A preferred hydrocarbon solvent is d-limonene.

D-limonene is a terpene which occurs naturally in all plants. It is a monocylic unsaturated terpene which is generally a by-product of the citrus industry, derived from the distilled rind oils of oranges, grapefruits, lemons, and the like. A discussion concerning d-limonene and its derivation from numerous sources is set forth in Kesterson, J. W., "Florida Citrus Oil," Institute of Food and Agriculture Science, University of Florida, December, 1971. D-limonene exhibits low human toxicity and is considered environmentally benign. It functions in the present inventive formulation as a portion of the solvent phase, for solubilizing the petroleum sludges, and as an absorbent for benzene contained in the oil sludges and the vapor spaces of the process equipment. Furthermore, d-limonene exhibits excellent solubility for the higher bitumen and asphaltene compounds commonly found in petroleum sludges. D-limonene is commercially available from Florida Chemical Company and from SMC Glidco Organics.

The hydrocarbon solvent may be present in the inventive formulation at a concentration from about 3 to about 96 weight percent. Preferably, the concentration is from about 5 to about 15 weight percent. Most preferably, the concentration of hydrocarbon solvent is about 10 weight percent.

Dipropylene glycol mono n-butyl ether according to the present invention acts synergistically with the hydrocarbon solvent as a second component of the solvent phase. It is a moderately polar solvent, having excellent solvency for petroleum compounds, including waxes, and for other polar compounds present in trace amounts in petroleum sludges. This solvent component is non-toxic, and exhibits a high flash point and low flammability making it safer to use than many other solvents. Finally, it contributes to the overall stability of the inventive formulation and acts as an important coupling agent between the hydrocarbon solvent and the aqueous phase of the micro emulsion produced using the instant heavy oil remover. The dipropylene glycol mono n-butyl ether may be present in the inventive formulation at a concentration from about 1 to about 94 weight percent. Preferably, the concentration ranges from about 5 to about 12 weight percent. Most preferably, the concentration of dipropylene glycol mono n-butyl ether is about 8 weight percent.

A volatility stabilizer is included in the inventive formulation, to prevent excessive evaporation of the solvents and to synergistically work therewith to provide improved heavy oil removal ability. Suitable volatility stabilizers include, but are not necessarily limited to, coconut oil methyl esters, sunflower oil methyl esters, soybean oil methyl esters, benzyl benzoate, dimethyl adipate, dimethyl glutarate, dimethyl succinate, as well as blends thereof. A preferred volatility stabilizer comprises a blend of coconut oil methyl esters and sunflower oil methyl esters which may be obtained from Alzo Inc. Of Matawan, N.J. under the trade designation "DEGREEZ." The volatility stabilizer may be present in the inventive formulation at a concentration from about 1 to about 95 weight percent. Preferably, the concentration ranges from about 5 to about 15 weight percent. Most preferably, the concentration of volatility stabilizer is about 10 weight percent.

An amine, alkali metal, or ammonium salt of an alkyl aromatic sulfonic acid is included in the inventive formulation as an anionic emulsifier. The alkylaromatic hydrophobe solubilizes well in petroleum sludges, and the degree of its solubility is modified by the presence of cosurfactants described hereinafter. The alkylaromatic sulfonate bond with the alkyl radical is weaker than a bond between an alkylaromatic sulfonate radical and an alkali metal atom such as sodium. This is important in controlling the degree to which the final product is able to emulsify the petroleum sludge, because a weak emulsion that is easily broken by the presence of minerals in the residual water and fluids in the process equipment being cleaned, is desirable in order to rapidly recover the oil which is ultimately separated. Moreover, the use of an alkylamine salt in a preferred embodiment eliminates the need for an ammonium salt as used in many conventional degreasers. Additionally, this preferred surfactant emulsifier produces little foam, compared to conventional anionic surfactants. Conveniently, this preferred ingredient, due to its weakly bound amine functional group, acts as an aggressive absorber and partial neutralizer for acidic gases such as hydrogen sulfide. Finally, the alkylamine salt according to the preferred embodiment of the present invention is a strong emulsifier for the solvent phase of the heavy oil remover, and contributes to the increased shelf life of the microemulsion formed between the hydrocarbon solvent/dipropylene glycol mono n-butyl ether cosolvent mixture and water. The required ingredient may be an amine, alkali metal, or ammonium salt of an alkyl benzene or alkyl naphthalene sulfonic acid. Suitable examples include, but are not limited to, an isopropylamine salt of linear dodecylbenzene sulfonic acid, an isopropylamine salt of branched dodecylbenzene sulfonic acid, a diethanolamine salt of linear or branched dodecylbenzene sulfonic acid, and the like, as well as mixtures thereof. A preferred salt of an alkyl aromatic sulfonic acid is isopropylamine linear dodecylbenzene sulfonate, available from the Pilot Chemical Company of Los Angeles, Calif. under the trade identifier "CALIMULSE PRS." The alkyl aromatic salt may be present in the inventive formulation at a concentration from about 2 to about 95 weight percent. Preferably, the concentration ranges from about 10 to 20 weight percent. Most preferably, the salt of an alkyl aromatic sulfonic acid is present at a concentration of about 14 weight percent.

A branched alcohol ethoxylate is included according to the present invention as a nonionic surfactant and a self demulsifying detergent for reducing the emulsifying effects of the salt of an alkyl aromatic sulfonic acid. Without wishing to be bound by any particular theory describing the mechanism by which this ingredient contributes to the efficacy of the inventive heavy oil remover, it is believed that the branched alcohol hydrophobe interacts with the hydrophobic moiety of the alkyl aromatic salt primary emulsifier. This weakens the emulsification potential of the alkyl aromatic salt to a degree that the trace minerals present in the residual water or fluids in the process equipment being cleaned electrolytically assist the demulsification of the heavy oil from the extractant cleaning mixture, thereby promoting the recovery of the heavy oil. A preferred branched alcohol ethoxylate according to the present invention is available from Tomah Products, Inc. of Milton, Wis. under the trade designation "TEKSTIM 8741." The branched alcohol ethoxylate may be present in the inventive formulation at a concentration from about 0.1 to about 75 weight percent. Preferably, the concentration ranges from about 1 to about 8 weight percent. Most preferably, the concentration of branched alcohol ethoxylate is about 4 weight percent.

An ethoxylated alkyl mercaptan is included in the inventive formulation as a second cosurfactant and emulsifier. This ingredient utilizes sulfur chemistry to form an emulsifier having a particularly high affinity for penetrating heavy oil sludges at high dilution levels in the presence of residual water and fluids contained in the process equipment being cleaned. Furthermore, the sulfhydryl functional groups can chemically bind hydrogen sulfide by reacting therewith to produce complex disulfide functional groups bound to the organic hydrophobe, thereby fixing the free hydrogen sulfide present in the heavy oil sludge and the vapor space of the process equipment being cleaned. The presence of the ethoxylate/ethereal functional groups, which are unaffected by the terminal mercaptan functional group reactions with hydrogen sulfide, assure that some hydrophilicity remains after these reactions occur, and thereby allow the surfactant properties of the ingredient to remain manifest. A preferred ethoxylated alkyl mercaptan may be obtained form the Burlington Chemical Company of Burlington, N.C. under the trade designation "BURCO TME." The ethoxylated alkyl mercaptan may be present in the inventive formulation at a concentration from about 0.1 to about 75 weight percent.

Preferably, the concentration ranges from about 1 to about 7 weight percent. Most preferably, the concentration of ethoxylated alkyl mercaptan is about 3 weight percent.

Water is included in the present invention and makes up the balance of the total weight of the mixture. The concentration of water may range up to about 95 weight percent.

In operation, the process equipment to be cleaned by the inventive formulation is drained of process fluids after the equipment has been shut down. Thereafter, the inventive heavy oil remover may be recirculated, either neat or in a diluted form, through the process equipment. Although the inventive formulation may be used at ambient temperatures, the rate of heavy oil removal may be accelerated by heating the recirculating stream. It has been observed that the heavy oil remover according to the present invention is effective at a dilution rate of up to about 95 weight percent water. Finally, the recirculated heavy oil remover, after it has solubilized the petroleum sludges and absorbed the toxic and acid gases, is recovered, and the oil phase separated for further processing.

EXAMPLE

The following ingredients are mixed together in the approximate weight percentages indicated, to prepare a heavy oil remover according to the present invention. Thereafter, the formulation is recirculated through the process equipment to be cleaned. After the heavy oil sludge is solubilized, the recirculating heavy oil remover solution is recovered and the oil is separated therefrom.

TABLE I

HEAVY OIL REMOVER

| Ingredient | Weight Percent |
|---|---|
| hydrocarbon solvent (1) | 10 |
| dipropylene glycol mono n-butyl ether | 8 |
| coconut and sunflower oil methyl esters (2) | 10 |
| salt of an alkyl aromatic sulfonic acid (3) | 14 |
| branched alcohol ethoxylate (4) | 4 |
| ethoxylated alkyl mercaptan (5) | 3 |
| water | 51 |

(1) Light Straight Run Gasoline.
(2) DEGREEZ, from Alzo Inc.
(3) CALIMULSE PRS, from Pilot Chemical Company.
(4) TEKSTIM 8741, from Tomah Products, Inc.
(5) BURCO TME, from Burlington Chemical Company.

The Example may be repeated with similar success by substituting the generically or specifically described ingredients and/or concentrations recited herein for those used in the preceding Example.

From the foregoing description, one ordinarily skilled in the art can easily ascertain the essential characteristics of this invention and, without departing from its spirit or scope, can make various changes and/or modifications to adapt the invention to various uses and conditions.

What is claimed is:

1. A heavy oil remover, comprising:

from about 3 to about 96 weight percent hydrocarbon solvent, wherein the hydrocarbon solvent is d-limonene, a terpene, a terpenoid, light straight run gasoline, catalytic reformate, hydrocracked gasoline, catalytically cracked gasoline, polymer gasoline, alkylate, #1 fuel oil, #2 fuel oil, kerosene, jet fuel, diesel fuel, heating oil, furnace oil, naphtha, middle distillate, white oil, lubricating oil, gas oil, cyclopentane, methylcyclopentane, dimethylcyclopentane, cyclohexane, methylcyclohexane, 1,2-dimethylcyclohexane, decahydronaphthalene, or a mixture thereof;

from about 1 to about 94 weight percent dipropylene glycol mono n-butyl ether;

from about 1 to about 95 weight percent volatility stabilizer;

from about 2 to about 95 weight percent salt of an alkyl aromatic sulfonic acid;

from about 0.1 to about 75 weight percent branched alcohol ethoxylate;

from about 0.1 to about 75 weight percent ethoxylated alkyl mercaptan; and up to about 95 weight percent water.

2. The heavy oil remover according to claim 1, wherein the concentration of hydrocarbon solvent ranges from about 5 to about 15 weight percent.

3. The heavy oil remover according to claim 2, wherein the concentration of hydrocarbon solvent is about 10 weight percent.

4. The heavy oil remover according to claim 1, wherein the hydrocarbon solvent is gasoline, diesel fuel, gas oil, d-limonene, or a mixture thereof.

5. The heavy oil remover according to claim 1, wherein the concentration of dipropylene glycol mono n-butyl ether ranges from about 5 to about 12 weight percent.

6. The heavy oil remover according to claim 5, wherein the concentration of dipropylene glycol mono n-butyl ether is about 8 weight percent.

7. The heavy oil remover according to claim 1, wherein the concentration of volatility stabilizer ranges from about 5 to about 15 weight percent.

8. The heavy oil remover according to claim 7, wherein the concentration of volatility stabilizer is about 10 weight percent.

9. The heavy oil remover according to claim 1, wherein the volatility stabilizer is selected from the group consisting of coconut oil methyl esters, sunflower oil methyl esters, soybean oil methyl esters, benzyl benzoate, dimethyl adipate, dimethyl gluterate, dimethyl succinate, and blends thereof.

10. The heavy oil remove,r according to claim 9, wherein the volatility stabilizer comprises a blend of coconut oil methyl esters and sunflower oil methyl esters.

11. The heavy oil remover according to claim 1, wherein the concentration of salt of an alkyl aromatic sulfonic acid ranges from about 10 to about 20 weight percent.

12. The heavy oil remover according to claim 11, wherein the concentration of salt of an alkyl aromatic sulfonic acid is about 14 weight percent.

13. The heavy oil remover according to claim 1, wherein the salt of an alkyl aromatic sulfonic acid is isopropylamine linear dodecylbenzene sulfonate.

14. The heavy oil remover according to claim 1, wherein the concentration of branched alcohol ethoxylate ranges from about 1 to about 8 weight percent.

15. The heavy oil remover according to claim 14, wherein the concentration of branched alcohol ethoxylate is about 4 weight percent.

16. The heavy oil remover according to claim 1, wherein the concentration of ethoxylated alkyl mercaptan ranges from about 1 to about 7 weight percent.

17. The heavy oil remover according to claim 16, wherein the concentration of ethoxylated alkyl mercaptan is about 3 weight percent.

18. A heavy oil remover, comprising:

from about 5 to about 15 weight percent hydrocarbon solvent, wherein the hydrocarbon solvent is d-limonene, a terpene, a terpenoid, light straight run gasoline, catalytic reformate, hydrocracked gasoline, catalytically cracked gasoline, polymer gasoline, alkylate, #1 fuel oil, #2 fuel oil, kerosene, jet fuel, diesel fuel, heating oil, furnace oil, naphtha, middle distillate, white oil, lubricating oil, gas oil, cyclopentane, methylcyclopentane, dimethylcyclopentane, cyclohexane, methylcyclohexane, 1,2-dimethylcyclohexane, decahydronaphthalene, or a mixture thereof;

from about 5 to about 12 weight percent dipropylene glycol mono n-butyl ether;

from about 5 to about 15 weight percent volatility stabilizer;

from about 10 to about 20 weight percent salt of an alkyl aromatic sulfonic acid;

from about 1 to about 8 weight percent branched alcohol ethoxylate;

from about 1 to about 7 weight percent ethoxylated alkyl mercaptan; and up to about 95 weight percent water.

19. The heavy oil remover according to claim 18, wherein the concentration of hydrocarbon solvent is about 10 weight percent.

20. The heavy oil remover according to claim 18, wherein the hydrocarbon solvent is gasoline, diesel fuel, gas oil, d-limonene, or a mixture thereof.

21. The heavy oil remover according to claim 18, wherein the concentration of dipropylene glycol mono n-butyl ether is about 8 weight percent.

22. The heavy oil remover according to claim 18, wherein the concentration of volatility stabilizer is about 10 weight percent.

23. The heavy oil remover according to claim 18, wherein the volatility stabilizer comprises a blend of coconut oil methyl esters and sunflower oil methyl esters.

24. The heavy oil remover according to claim 18, wherein the concentration of salt of an alkyl aromatic sulfonic acid is about 14 weight percent.

25. The heavy oil remover according to claim 18, wherein the salt of an alkyl aromatic sulfonic acid is isopropylamine linear dodecylbenzene sulfonate.

26. The heavy oil remover according to claim 18, wherein the concentration of branched alcohol ethoxylate is about 4 weight percent.

27. The heavy oil remover according to claim 18, wherein the concentration of ethoxylated alkyl mercaptan is about 3 weight percent.

28. A heavy oil remover, comprising:

about 10 weight percent hydrocarbon solvent, wherein the hydrocarbon solvent is d-limonene, a terpene, a terpenoid, light straight run gasoline, catalytic reformate, hydrocracked gasoline, catalytically cracked gasoline, polymer gasoline, alkylate, #1 fuel oil, #2 fuel oil, kerosene, jet fuel, diesel fuel, heating oil, furnace oil, naphtha, middle distillate, white oil, lubricating oil, gas oil, cyclopentane, methylcyclopentane, dimethylcyclopentane, cyclohexane, methylcyclohexane, 1,2-dimethylcyclohexane, decahydronaphthalene, or a mixture thereof, about 8 weight percent dipropylene glycol mono n-butyl ether;

about 10 weight percent of a blend of coconut oil methyl esters and sunflower oil methyl esters;

about 14 weight percent isopropylamine linear dodecylbenzene sulfonate;

about 4 weight percent branched alcohol ethoxylate;

about 3 weight percent ethoxylated alkyl mercaptan; and the balance water.

29. The heavy oil remover according to claim 28, wherein the hydrocarbon solvent is gasoline, diesel fuel, gas oil, d-limonene, or a mixture thereof.

* * * * *